US007377038B2

(12) United States Patent
Bowman et al.

(10) Patent No.: US 7,377,038 B2
(45) Date of Patent: May 27, 2008

(54) METHOD FOR ASSEMBLING A CATALYIC CONVERTER

(75) Inventors: James R. Bowman, Indianapolis, IN (US); Peter Kroner, Augsburg (DE)

(73) Assignee: EMCON Technologies, LLC, Wilmington, DE (US)

( * ) Notice: Subject to any disclaimer, the term of this patent is extended or adjusted under 35 U.S.C. 154(b) by 398 days.

(21) Appl. No.: 11/144,283

(22) Filed: Jun. 3, 2005

(65) Prior Publication Data

US 2006/0272153 A1 Dec. 7, 2006

(51) Int. Cl.
*B21D 51/16* (2006.01)
*G01R 31/28* (2006.01)
*B23Q 13/00* (2006.01)

(52) U.S. Cl. ..... 29/890; 29/593; 29/420; 29/407.1

(58) Field of Classification Search ..... 29/854, 29/593, 520, 407.1, 407.09, 407.08, 407.05, 29/890; 72/85, 19.9; 73/668
See application file for complete search history.

(56) References Cited

U.S. PATENT DOCUMENTS

| | | | | |
|---|---|---|---|---|
| 6,381,843 | B1 | 5/2002 | Irie | |
| 6,591,497 | B2 * | 7/2003 | Foster et al. | 29/890 |
| 6,591,498 | B2 | 7/2003 | Irie | |
| 6,732,429 | B2 * | 5/2004 | Houliang et al. | 29/854 |
| 6,769,281 | B2 * | 8/2004 | Irie et al. | 72/121 |
| 2002/0033385 | A1 * | 3/2002 | Alte et al. | 219/121.46 |
| 2002/0057998 | A1 * | 5/2002 | Foster et al. | 422/179 |
| 2003/0167854 | A1 * | 9/2003 | Irie et al. | 73/818 |
| 2004/0031149 | A1 | 2/2004 | Irie | |
| 2005/0005446 | A1 * | 1/2005 | Mayfield | 29/890 |

FOREIGN PATENT DOCUMENTS

| | | | |
|---|---|---|---|
| EP | 0703354 | A | 3/1996 |
| EP | 0982480 | A | 3/2000 |
| EP | 1 344 911 | A | 9/2003 |
| EP | 1389675 | A | 2/2004 |
| EP | 1635048 | A | 3/2006 |
| JP | 2000303831 | | 10/2000 |
| WO | WO 99/32215 | A | 7/1999 |
| WO | WO 02/095198 | A | 11/2002 |
| WO | WO 02/095198 | A1 | 11/2002 |
| WO | WO 03/033886 | A | 4/2003 |

OTHER PUBLICATIONS

International Search Report dated Aug. 21, 2006.
International Preliminary Report on Patentability dated Dec. 21, 2007.

* cited by examiner

*Primary Examiner*—David P. Bryant
*Assistant Examiner*—Alexander P Taousakis
(74) *Attorney, Agent, or Firm*—Carlson, Gaskey & Olds

(57) ABSTRACT

A substrate assembly is stuffed into a converter outer shell to form a catalytic converter having a desired gap bolt density (GBD) value. The substrate assembly is formed by wrapping and taping a mat around a catalytic substrate. A predetermined pressure is applied to the substrate assembly and an outer diameter of the substrate assembly is measured at this predetermined pressure. A GBD value is predicted based on this measurement and if the GBD value is acceptable the substrate assembly is stuffed into the converter outer shell.

20 Claims, 2 Drawing Sheets

METHOD FOR ASSEMBLING A CATALYIC CONVERTER

TECHNICAL FIELD

The subject invention relates to a method of assembling a catalytic converter where a density characteristic is predicted prior to stuffing a substrate assembly into a converter outer shell to determine whether an assembled combination of the substrate assembly and the converter outer shell will meet desired standards.

BACKGROUND OF THE INVENTION

Catalytic converters are typically assembled by stuffing a substrate assembly into a converter outer shell. The substrate assembly is formed by wrapping an insulating mat around a catalytic substrate. The mat is then held in place by tape. Pressure is applied to the substrate assembly to compress the mat around the catalytic substrate. An outer diameter of the substrate assembly is measured during application of the pressure. A predicted outer diameter of the converter outer shell is then determined based on this outer diameter measurement of the substrate assembly. The substrate assembly is then lightly stuffed into the converter outer shell and the converter outer shell is subjected to subsequent forming operations to reduce the converter outer shell to the predicted outer diameter.

This traditional assembly method has some disadvantages. The subsequent forming operations utilize a complex eight (8) segmented tool assembly, which is time consuming and expensive. Further, each final assembled catalytic converter should have a desired density characteristic. No density predictions, measurements, or calculations are performed during this traditional assembly method. Thus, there is no way to determine during assembly whether a final assembled catalytic converter has the desired density characteristic.

Another assembly method utilizes a hard stuff approach. In this approach, the insulating mat is wrapped around the catalytic substrate in a manner similar to that described above. No diameter measurements are taken of the substrate assembly. The substrate assembly is simply hard stuffed into a converter outer shell that has a fixed final diameter.

In this assembly method, the amount of push-in force is measured to indirectly determine whether or not the catalytic converter will have the desired density characteristic. If the push-in force is too low then the catalytic converter is not acceptable and is scrapped. This process is costly as the converter outer shell, mat, and catalytic substrate are all scrapped when the push-in force is too low.

Another hard stuff assembly process weighs the insulating mat prior to hard stuffing. If the weight of the insulating mat is too low, then the insulating mat is scrapped. While this identifies a problem prior to stuffing the substrate assembly into the converter outer shell, this method still has the disadvantage of a high scrap rate.

Thus, there is a need for a method of assembling a catalytic converter that reduces scrap rates, and which does not require additional forming steps on the converter outer shell subsequent to stuffing. The method of assembly should be simple, efficient, and more cost effective than prior methods in addition to overcoming other deficiencies in the prior art outlined above.

SUMMARY OF THE INVENTION

A substrate assembly is stuffed into a converter outer shell to form a catalytic converter. A mat is wrapped and taped around a catalytic substrate to form the substrate assembly. A predetermined level of pressure is applied to the substrate assembly and a substrate characteristic is determined during pressure application. The substrate characteristic is compared to a desired characteristic standard and if the desired characteristic standard is satisfied, the substrate assembly is stuffed into the converter outer shell. If the desired characteristic standard is not satisfied, the substrate assembly is re-worked and not scrapped.

In one example, the converter outer shell has a fixed diameter. An outer diameter of the substrate assembly is measured during pressure application. In this example, the substrate characteristic comprises a gap bulk density, which is calculated based on the outer diameter of the substrate assembly and the fixed diameter of the converter outer shell. If the gap bulk density is satisfactory, the substrate assembly is then hard stuffed into the converter outer shell to form a final catalytic converter assembly. No further forming steps are required for the converter outer shell to achieve a desired diameter.

The subject invention provides a method of assembling a catalytic converter that reduces scrap rates, and which allows for a hard stuff with no additional forming of the converter outer shell required. These and other features of the present invention can be best understood from the following specification and drawings, the following of which is a brief description.

DETAILED DESCRIPTION OF THE PREFERRED EMBODIMENT

Figure 1:
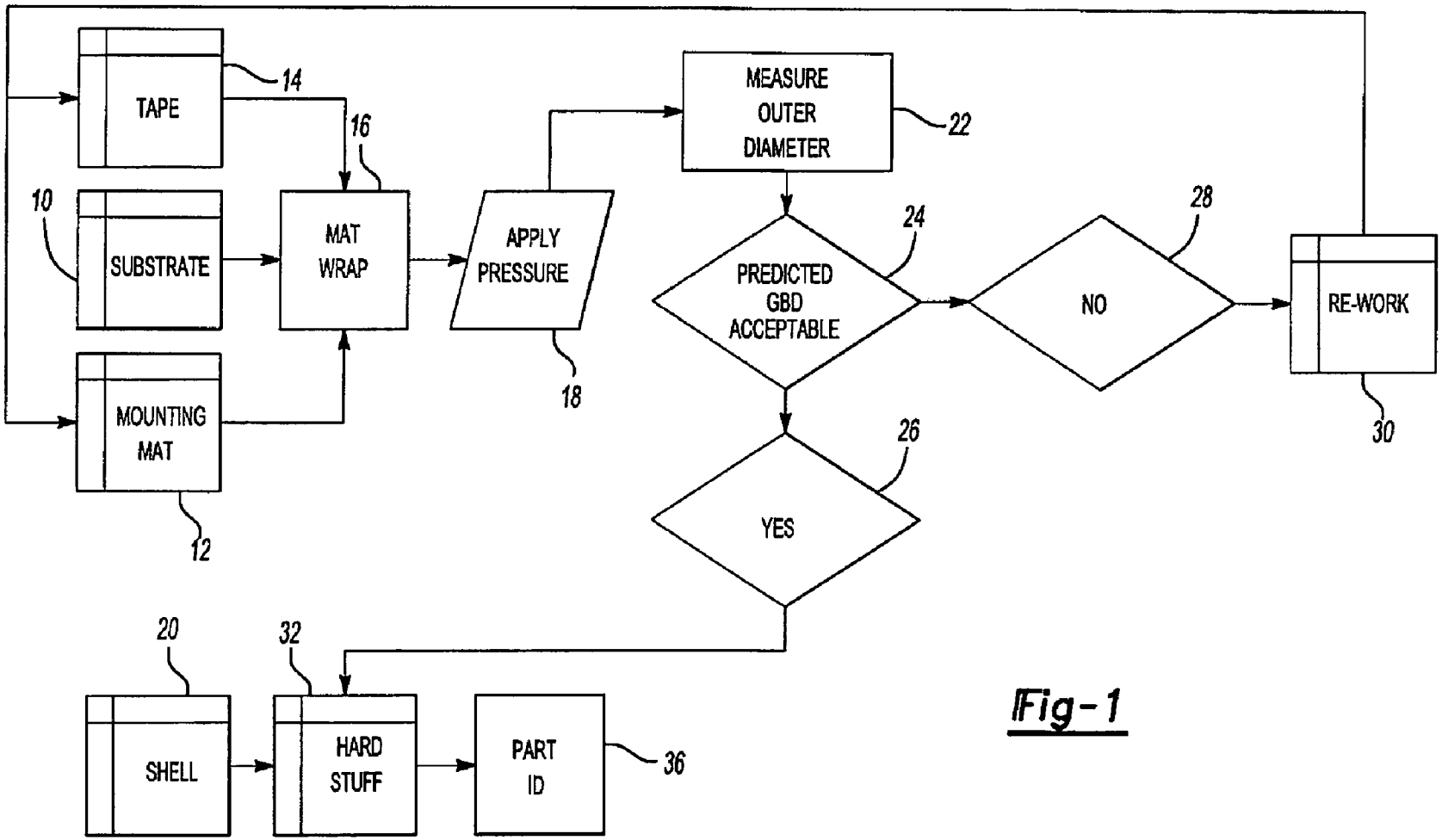
FIG. 1 is a flow diagram of an assembly method incorporating the subject invention.

A flow diagram showing assembly steps for assembling a catalytic converter (not shown) is shown in FIG. 1. Operating characteristics of the catalytic converter are well known and will not be discussed in detail. Further, the structural components and materials that are used to form the catalytic converter are also well known and will not be discussed in detail. The subject invention is directed to a unique assembly method that includes a quality check to identify sizing and tolerance stack-up issues prior to having a final assembled catalytic converter.

The catalytic converter includes a substrate assembly that has a catalytic substrate 10 and a mounting mat 12 that also provides insulation. Tape 14 is used to secure the mounting mat 12 around the catalytic substrate 10. At step 16, the mounting mat 12 is wrapped around the catalytic substrate 10 and is taped in place with tape 14. At step 18, a known pressure is applied to the substrate assembly to compress the mounting mat 12 and catalytic substrate together. The process and structure used to apply this pressure is well known.

After pressure application, the substrate assembly is stuffed into an internal cavity defined by an outer shell 20 of the catalytic converter. The subject invention uses known and measured substrate assembly and outer shell characteristics to predict whether the substrate assembly, in combination with the outer shell 20, will meet desired operational standards. In other words, during assembly a quality check is performed to identify potential sizing and tolerance stack-up issues for the substrate assembly that can ultimately affect component performance.

The quality check involves comparing an identified substrate assembly characteristic to a desired characteristic standard. If the identified substrate assembly characteristic meets or satisfies the desired characteristic standard then the substrate assembly is acceptable and can be subsequently stuffed into the outer shell 20. If the identified substrate assembly characteristic does not meet the desired characteristic standard then the substrate assembly is re-worked with a new mounting mat 12.

An example of one important substrate assembly characteristic is gap bulk density (GBD). GBD generally refers to the amount of compressed mounting mat material within a specified area. During the pressure application at step 18, an outer diameter of the substrate assembly is measured at step 22. The outer diameter is then used to predict a GBD value for the substrate assembly, as indicated at 24. The GBD is compared to a desired GBD value and if acceptable, as indicated at 26, the assembly process proceeds. If predicted GBD is not acceptable, as indicated at 28, the substrate assembly is re-worked with a new mounting mat 12, as indicated at 30.

Once the substrate assembly has an acceptable GBD value, the substrate assembly is stuffed into the outer shell. This stuffing step can either be performed as a hard stuff, as indicated at 32 in FIG. 1, or can be a light stuff, as indicated at 34 in FIG. 2.

The hard stuff process uses an outer shell 20 that has a fixed or known diameter. During prediction of the GBD at step 24, the GBD is calculated based on the known diameter of the outer shell 20 and the measured diameter of the substrate assembly from step 22. If the predicted/calculated GBD value is acceptable, the substrate assembly is hard stuffed into the outer shell 20 at step 32. Final component verification is then performed at step 36. No additional forming operations are required fro the outer shell 20.

Figure 2:
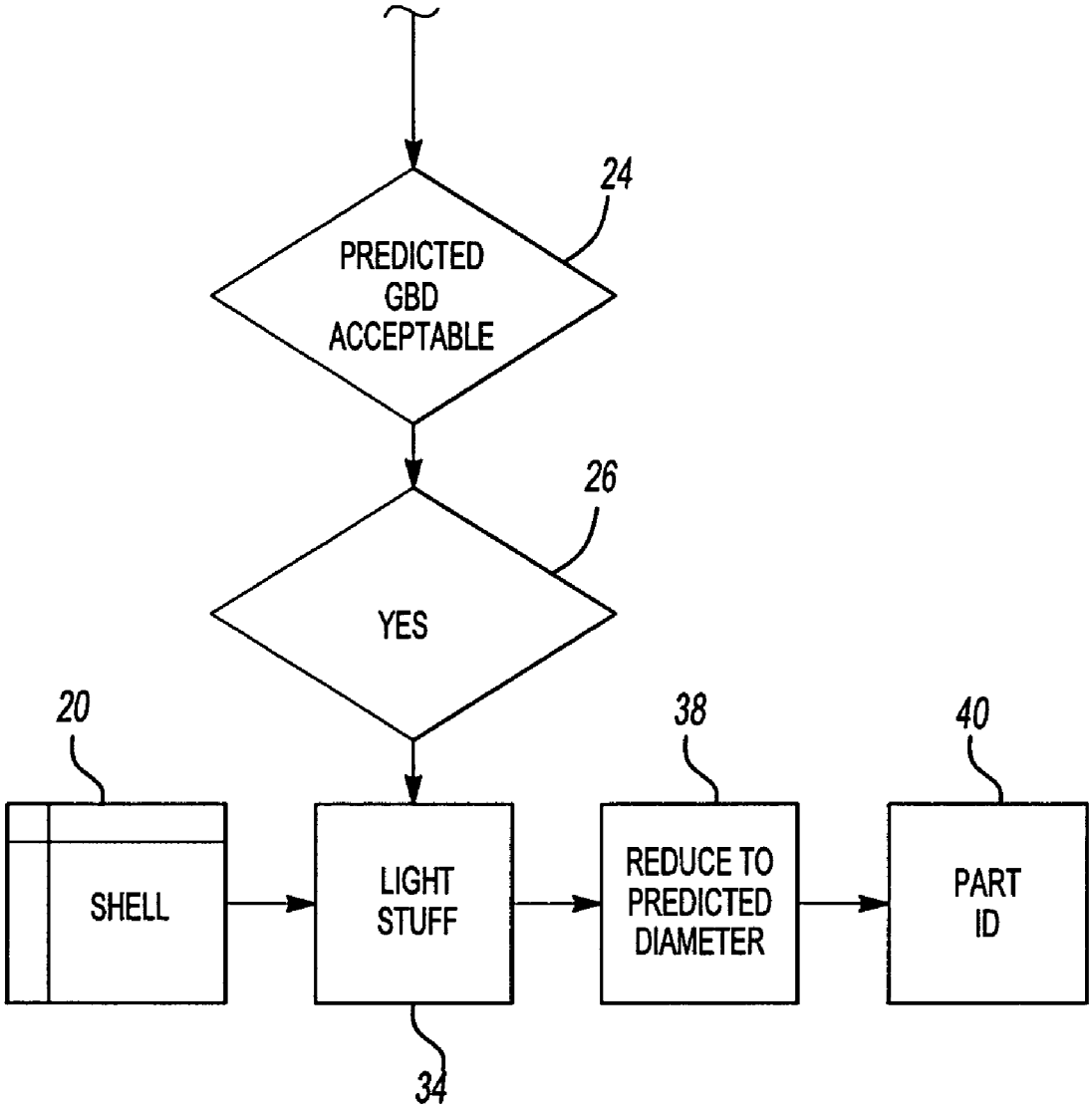
FIG. 2 is a flow diagram showing an alternate assembly method incorporating the subject invention.

Optionally, the light stuff process could be used as shown in FIG. 2. During prediction of the GBD at step 24, the GBD is calculated based on a predicted outer diameter of the outer shell 20 and the measured diameter of the substrate assembly from step 22. If the predicted/calculated GBD value is acceptable at step 26, the substrate assembly is lightly stuffed into the outer shell 20 at step 34. The outer shell 20 is then subjected to additional forming operations at step 38 to reduce the outer shell 20 to the predicted outer diameter. The process and structure required to form and reduce the outer shell 20 to the predicted outer diameter is well known. Final component verification is then performed at step 40.

The assembly process shown in FIG. 1 is preferred over the assembly process shown in FIG. 2 because additional forming operations do not have to be performed on the outer shell 20 subsequent to stuffing the substrate assembly into the outer shell 20. However, in either configuration, the acceptability of the GBD for the substrate assembly is easily determined prior to stuffing. Evaluating the mounting mat 12 and catalytic substrate 10 together before stuffing leads to reduced scrap. Further, the subject assembly process has an advantage over processes that sort the mounting mat 12 alone on the basis of weight because evaluation is based on a statistical fit of the tolerance stack-up of the mounting mat 12 and catalytic substrate 10 as opposed to a linear fit based on the mounting mat 12 alone.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method for assembling a catalytic converter comprising:

(a) wrapping a mat around a catalytic substrate to form a substrate assembly;

(b) applying a predetermined pressure to the substrate assembly;

(c) determining a substrate characteristic of the substrate assembly at the predetermined pressure;

(d) comparing the substrate characteristic to a desired substrate standard;

(e) identifying an acceptable substrate assembly when the substrate characteristic satisfies the desired substrate standard; and (f) stuffing the acceptable substrate assembly into a converter outer shell to form a catalytic converter.

2. The method according to claim 1 wherein step (c) includes measuring an outer diameter of the substrate assembly at the predetermined pressure.

3. The method according to claim 2 wherein the substrate characteristic comprises gap bulk density and wherein step (c) includes determining the gap bulk density based on the outer diameter of the substrate assembly at the predetermined pressure and a predicted converter outer shell diameter.

4. The method according to claim 3 wherein the converter outer shell has a first diameter prior to step (f) and a second diameter that is less than the first diameter after step (f).

5. The method according to claim 4 wherein step (f) includes light stuffing the substrate assembly into the converter outer shell and reducing the converter outer shell to the predicted converter outer shell diameter to form the catalytic converter.

6. The method according to claim 2 wherein the substrate characteristic comprises gap bulk density and wherein step (c) includes calculating the gap bulk density based on the outer diameter of the substrate assembly at the predetermined pressure and a known converter outer shell characteristic.

7. The method according to claim 6 wherein the converter outer shell has a fixed diameter that remains generally constant before and after step (f).

8. The method according to claim 7 wherein the known converter outer shell characteristic comprises the fixed diameter.

9. The method according to claim 8 wherein step (f) includes hard stuffing the substrate assembly into the converter outer shell to form the catalytic converter without requiring any additional forming operations on the converter outer shell.

10. A method for assembling a catalytic converter comprising:

(a) providing a catalytic substrate assembly and a converter outer shell having a fixed shell diameter and an internal cavity for receiving the catalytic substrate assembly;

(b) measuring an outer diameter of the catalytic substrate assembly at a known pressure;

(c) predicting a gap bulk density value based on the outer diameter and the fixed shell diameter; and (d) stuffing the catalytic substrate assembly into the internal cavity if the gap bulk density value is acceptable.

11. The method according to claim 10 wherein step (c) is performed before step (d).

12. The method according to claim 11 wherein step (a) includes wrapping a mat around a catalytic substrate to form the catalytic substrate assembly and wherein step (b) includes applying the known pressure to the catalytic substrate assembly prior to measuring the outer diameter.

13. The method according to claim 12 including comparing the gap bulk density value to a desired gap bulk density value prior to stuffing the catalytic substrate assembly into the internal cavity.

14. The method according to claim 10 including reworking the catalytic substrate assembly if the gap bulk density is not acceptable prior to step (d).

15. The method according to claim 10 wherein the catalytic substrate assembly comprises a catalytic substrate with a mat wrapped around the catalytic substrate, and including the steps of comparing a predicted gap bulk density value determined from step (c) to a desired gap bulk density value, identifying an unacceptable substrate assembly when the predicted gap bulk density value does not satisfy the desired gap bulk density value, and reworking the unacceptable substrate assembly by removing the mat from the catalytic substrate, wrapping a new mat around the catalytic substrate to form a second catalytic substrate assembly, and repeating steps (b)-(d) with the second catalytic substrate assembly.

16. The method according to claim 10 wherein a predicted gap bulk density value from step (c) is compared to a desired gap bulk density value prior to step (d).

17. The method according to claim 10 wherein step (a) includes wrapping a mat around a catalytic substrate to form the catalytic substrate assembly and wherein step (b) occurs subsequent to step (a).

18. The method according to claim 1 wherein step (e) further includes identifying an unacceptable substrate assembly when the substrate characteristic does not satisfy the desired substrate standard, and including reworking the unacceptable substrate assembly by removing the mat from the catalytic substrate, wrapping a new mat around the catalytic substrate to form a second substrate assembly, and repeating steps (b)-(f) with the second substrate assembly.

19. The method according to claim 1 wherein step (d) occurs prior to step (e) and wherein step (e) occurs prior to step (f) to identify unacceptable substrate assemblies before the converter outer shell is stuffed; and including reworking unacceptable substrate assemblies into acceptable substrate assemblies.

20. The method according to claim 1 wherein the desired substrate standard comprises a desired gap bulk density value and wherein step (c) includes measuring an outer diameter of the substrate assembly at the predetermined pressure and predicting a gap bulk density value for the substrate assembly prior to step (d).

* * * * *

UNITED STATES PATENT AND TRADEMARK OFFICE

CERTIFICATE OF CORRECTION

PATENT NO. : 7,377,038 B2
APPLICATION NO. : 11/144283
DATED : May 27, 2008
INVENTOR(S) : Bowman et al.

It is certified that error appears in the above-identified patent and that said Letters Patent is hereby corrected as shown below:

ON THE TITLE PAGE, AND COL. 1, LINE 1
Item (54)
The title should read as:

METHOD FOR ASSEMBLING A CATALYTIC CONVERTER

Signed and Sealed this

Twelfth Day of August, 2008

JON W. DUDAS
*Director of the United States Patent and Trademark Office*